US011104980B2

(12) United States Patent
Saeuberlich et al.

(10) Patent No.: US 11,104,980 B2
(45) Date of Patent: Aug. 31, 2021

(54) CARBIDE WITH TOUGHNESS-INCREASING STRUCTURE

(71) Applicant: H.C. STARCK TUNGSTEN GMBH, Munich (DE)

(72) Inventors: Tino Saeuberlich, Bad Harzburg (DE); Johannes Poetschke, Dresden (DE); Volkmar Richter, Dresden (DE)

(73) Assignee: H. C. STARCK TUNGSTEN GMBH, Munich (DE)

( * ) Notice: Subject to any disclaimer, the term of this patent is extended or adjusted under 35 U.S.C. 154(b) by 166 days.

(21) Appl. No.: 16/093,709

(22) PCT Filed: Apr. 6, 2017

(86) PCT No.: PCT/EP2017/058216
§ 371 (c)(1),
(2) Date: Oct. 15, 2018

(87) PCT Pub. No.: WO2017/186468
PCT Pub. Date: Nov. 2, 2017

(65) Prior Publication Data

US 2019/0136353 A1 May 9, 2019

(30) Foreign Application Priority Data

Apr. 26, 2016 (DE) ..... 10 2016 207 028.2

(51) Int. Cl.
*C22C 29/08* (2006.01)
*B22F 3/15* (2006.01)
(Continued)

(52) U.S. Cl.
CPC ..... *C22C 29/08* (2013.01); *B22F 3/105* (2013.01); *B22F 3/15* (2013.01); *B22F 3/16* (2013.01);
(Continued)

(58) Field of Classification Search
CPC ..... C22C 29/08; C22C 29/00; C22C 29/067; B22F 3/16; B22F 2302/10
See application file for complete search history.

(56) References Cited

U.S. PATENT DOCUMENTS 5,593,474 A 1/1997 Keshavan et al.
5,880,382 A 3/1999 Fang et al.
(Continued)

FOREIGN PATENT DOCUMENTS

DE 102004051288 A1 4/2006
EP 1048750 A1 * 11/2000 ..... C23C 28/048
(Continued)

OTHER PUBLICATIONS

Sun et al., International Journal of Refractory Metals and Hard Materials, vol. 29, No. 2, Sep. 8, 2010, pp. 147-152.
(Continued)

*Primary Examiner* — Scott R Kastler
(74) *Attorney, Agent, or Firm* — Dilworth IP, LLC

(57) ABSTRACT

The invention relates to a method for producing a carbide with a toughness-increasing structure, comprising the following steps: providing a hard material powder, wherein the average BET particle size of the hard material powder is less than 1.0 mm; mixing the hard material powder with a binder powder; shaping the mixture made of hard material powder and binder powder to form a green body; and sintering the green body. The invention also relates to a carbide with a toughness-increasing structure comprising a phase made of hard material particles and a phase made of binder metal heterogeneously distributed in the carbide, which is present in the form of binder islands, wherein the carbide with a toughness-increasing structure produced after the sintering has a phase made of hard material particles with an average particle size in the region between 1 nm and 1000 nm, and the binder islands have an average size of 0.1 μm to 10.0 μm
(Continued)

and an average distance between the binder islands of 1.0 μm to 7.0 μm.

22 Claims, 2 Drawing Sheets

(51) Int. Cl.
*B22F 3/105* (2006.01)
*B22F 3/16* (2006.01)
*B22F 5/02* (2006.01)
*B22F 5/00* (2006.01)

(52) U.S. Cl.
CPC ..... *B22F 5/02* (2013.01); *B22F 2005/001* (2013.01); *B22F 2302/10* (2013.01); *B22F 2998/10* (2013.01)

(56) References Cited

U.S. PATENT DOCUMENTS

2010/0223856 A1* 9/2010 Davies ..... C22C 26/00 51/307
2015/0314421 A1* 11/2015 Can ..... B22F 3/14 51/309
2016/0251741 A1* 9/2016 Kanyanta ..... B24D 18/0009 51/307

FOREIGN PATENT DOCUMENTS

JP 1999181540 A 7/1999
JP 2004059946 A 2/2004
JP 2008001918 A 1/2008
JP 2009097081 A 5/2009
JP 2013040396 A 2/2013
RU 2048569 C1 11/1995
SU 1604166 A3 10/1990
WO 2011058167 A1 5/2011

OTHER PUBLICATIONS

Huang et al., Materials Science and Engineering: A, vol. 475, No. 1-2, Jan. 28, 2008, pp. 87-91, Elsevier.
Huang et al., International Journal of Refractory Metals & Hard Materials, vol. 25, No. 5-6, Sep. 1, 2007, pp. 417-422.
Spiegler et al., Journal of Hard Materials, vol. 1, No. 3, Jan. 1, 1990, pp. 147-158.
Deng et al., International Journal of Refractory Metals & Hard Materials, vol. 19 (2001) pp. 547-552.
Shetty et al., Journal Material Science, vol. 20 (1985) pp. 1873-1882.
PCT International Search Report and Written Opinion dated Jul. 31, 2017 from corresponding Application No. PCT/EP2017/058216, 19 pages.
Xiaoguang Sun et al, Mechanical properties and erosion resistance of ceria nano-particle-doped ultrafine WC-12Co composite prepared by spark plasma sintering, Wear, Elsevier, 2013, vol. 301, Issues—2, pp. 406-414.
Japanese Office Action dated Oct. 16, 2019 in related Japanese Patent Application No. 2018-554372; 12 pages.

* cited by examiner

CARBIDE WITH TOUGHNESS-INCREASING STRUCTURE

TECHNICAL FIELD

The present invention relates to the technical field of material sciences. The invention relates to cemented carbides with toughness-increasing structures that combine a high hardness and a high fracture toughness, and to the preparation of cemented carbides by a process in which the sintering of the green body is performed by solid-phase sintering, and to the use of such cemented carbide.

BACKGROUND OF THE INVENTION

A cemented carbide is an alloy prepared by powder metallurgy from a hard material, such as mostly tungsten carbide (WC), and a binder metal, usually from the iron group (iron, cobalt, nickel). A cemented carbide consists, for example, of from 70% by mass to 98% by mass of tungsten carbide and from 2% by mass to 30% by mass of cobalt. The tungsten carbide grains usually have a grain size of from 0.3 μm to 10 μm. A second component, mostly cobalt (or iron, nickel, or a combination of cobalt, iron, nickel) is added as a matrix, binder, binding metal, cement and toughness component, and fills the spaces between the tungsten carbide grains.

Cemented carbides are employed in a wide variety of technical fields of application in which the materials must have a high wear resistance and hardness, and a high strength.

The highest hardness values are achieved with low-binder cemented carbides and cemented carbides with extremely fine-grained hard materials. However, such alloys normally have a comparably low fracture toughness. The fracture toughness of low-binder cemented carbides and cemented carbides with extremely fine-grained hard materials is comparable with that of ceramic materials. Therefore, the attempt to improve the mechanical properties of the cemented carbide to obtain a higher hardness of the material has almost necessarily resulted in a simultaneous deterioration of fracture toughness to date in the prior art. Therefore, depending on the application and stress exposure, either cemented carbide alloys that were only very hard or, alternatively, alloys that have a good toughness, but at the same time a rather lower hardness, could be made available in the prior art.

To date, achieving a particular combination of mechanical properties in cemented carbides, especially in view of the hardness, fracture toughness and strength, has been done primarily through a selection of the grain size of the starting powder, the content of metallic binder, and the concentration of grain growth inhibitors. To date, methods have been established essentially in the prior art that could increase the hardness and strength of cemented carbide structures. In parallel, the production of nanoscale cemented carbides could also be optimized in known methods. However, it has not been possible to date to achieve a basically improved fracture toughness of cemented carbides by the previously known methods.

Also, it has been known to the skilled person that very fine-grained cemented carbides will be hard and brittle, and although increasing the binder content leads to a decrease of hardness, it results in an only moderate increase of fracture toughness. Previously, it has been assumed that free dislocation movements are no longer possible with very low free lengths of path in the binder.

In his dissertation (about 1976), Gille refers to a minimum value of average free length of path below which cobalt loses its ductile properties and becomes a brittle material because the metallic binder hardly allows any dislocation movements below a particular layer thickness and thus loses its plastic properties. This disadvantage is widely accepted as a material-related necessity.

This phenomenon could be counteracted in principle by concentrating part of the introduced binder in binder pools. However, corresponding structures with an "inhomogeneous cobalt distribution", in which the binder forms cobalt pools that are larger than (about) the average size of the hard material in the form of WC grains, have been considered as "undersintered" in the prior art to date. Very coarse binder accumulations, as may be formed, for example, in the hot isostatic after compaction of porous cemented carbides, are referred to as "binder pools" in this context.

The skilled person knew that the formation and presence of such binder pools would significantly reduce the strength of the alloy. Therefore, the structural phenomena responsible for it have been considered as undesirable and technically disadvantageous. For example, it has been assumed to date that such cemented carbides could have only strengths corresponding to those of a highly porous material, despite 100% density.

Therefore, only a few attempts have been made to date in the prior art to improve the toughness of the materials while the hardness and/or wear resistance is maintained.

DE 10 2004 051 288 A1 relates to ultrafine and nanoscale cemented carbides with cobalt as the binder metal, wherein a polycrystalline hard material in a bimodal form (polycrystalline tungsten carbide particles) must be present. The use of nanoscale polycrystalline hard material grains and the related increase of the average free lengths of path in the binder results in an improvement of the combination of hardness and fracture toughness. Depending on the application, the hard material aggregates can have average dimensions of a few micrometers to several hundreds of micrometers. The free length of path in the cobalt bonder component is usually below the size of the hard material aggregates within a range of up to a few micrometers, and is comparable with the average free length of path in conventional cemented carbides having fine, medium or coarse grains. In this range of dimensions of the binder, clear plastic deformation still occur in the binder upon fraction. With the fracture toughness, the breaking strength can also be increased as long as the cobalt accumulations do not become fracture-triggering defects. This occurs only when the latter reach the size of macropores. In DE 10 2004 051 288 A1, a very good hardness and fracture toughness was observed in the production of cemented carbides from superultrafine-grained and nanoscale tungsten carbide powders, in which the hard material was present in two distinct ductile matrix phases and therefore had to be employed in a bimodal form. However, this technology requires a relatively complicated production process, in which the preparation of specific polycrystalline hard material particles in bimodal form is effected in a first process step, which are processed to a cemented carbide only thereafter in a second process step.

An increase of toughness extending throughout the component while the hardness is kept constant can be achieved by introducing a further degree of freedom into the microstructure. U.S. Pat. No. 5,593,474 proposes a composite body for stone working that consists of two types of (bimodal) cemented carbide grains that are different in grain size and toughness and are mixed together before shaping.

The tougher type consists of WC having a grain size of 2.5 μm to 10 μm, while the grain size of the harder alloy is from 0.5 μm to 2 μm. The brittler grains comprise from 20% by mass to 65% by mass of the material. The sintered body consists of a mixture of zones with different WC grain sizes. The size of the zones results from the size of the grains employed and the change thereof during the pressing and sintering. In the contact zone, "dispersion zones" are formed by the migration of binder. A relatively constant hardness and toughness up to a content of fine-grained alloy of about 50% by mass is mentioned as an advantage. Proceeding from an alloy with a hardness of HRA 89.5 and a crack resistance according to Palmqvist of about 275 kgf/mm, the properties change by admixing an alloy with a hardness of HRA 91.3 and a crack resistance of 135 kgf/mm only within an interval of ±0.5 HRA units and ±10 units of crack resistance (in kgf/mm), wherein the increase of hardness is coupled with a decrease of crack resistance, and vice versa. Under certain circumstances, this is supposed to lead to an improved wear resistance of the alloy without adversely affecting toughness. However, a general improvement of the combination of hardness and fracture toughness is not achieved in this way. The uncertain volume fraction of the forming "dispersion zone" leads to a variance of the mechanical properties. The inventors are silent about the strength. However, because of the size of the introduced brittle regions, a significant decrease in strength is to be expected.

According to U.S. Pat. No. 5,880,382, a considerable improvement of toughness in high binder alloys is achieved by incorporating cemented carbide grains that are already densely sintered, such as those used for thermal spraying, into the metal matrix of cobalt or steel. A cemented carbide-like structure of very large and hard grains in a ductile matrix is formed thereby. However, the hard phase differs from the hard component cemented carbide in both size and inner structure. While the hard phase in conventional cemented carbide consists of crystals of WC having a mean span of 0.2 μm to 6 μm, the hard phase in the alloy may still have dimensions of up to 500 μm. In addition, the hard phase is itself a cemented carbide (i.e., a mixture of WC and Co), which is why this alloy is referred to as a "double cemented carbide" (DC carbide composite). It contains carbides of the transition metals W, Ti, Mo, Nb, V, Hf, Ta, Cr, for the grain size of which a range of from 1 μm to 15 μm is stated. These are bound by a metal from the group Fe, Co, Ni or by an alloy of such metals. For binders in the hard grains, referred to as the "first ductile phase", mass proportions of 3% by mass to 25% by mass are mentioned. The ductile matrix, referred to as the "second ductile phase", consists of at least one metal of the group Co, Ni, W, Mo, Ti, Ta, V, Nb and may contain further additives. The additives serve to control the melting point of the second ductile phase or to enhance its wear resistance. Additions of extremely finely distributed hard materials are proposed for enhancing the wear resistance of the second ductile phase. In the alloy, the second ductile phase comprises a volume of up to 40% by volume of the total volume. A volume proportion of 20% by volume to 40% by volume is considered particularly advantageous.

In a first process stage, the hard phase may be obtained according to the technology of the production of powders for thermal spraying, or through pellets to be broken. The hard grains are then mixed with a metal powder, and sintered into dense molded parts in a second phase. The compaction to a double cemented carbide is effected by so-called "rapid omnidirectional compaction" (ROC), hot pressing, solid phase or liquid phase sintering, hot isostatic pressing or forging. As another method, infiltration with a second ductile phase is described.

The thus obtained parts have a good combination of wear resistance and toughness, and are suitable, in particular, for the preparation of inserts of rock working tools, such as roller and percussion drills. Fracture toughness values of up to 40 $MPa \cdot m^{1/2}$ are achieved. However, such high values only result in particularly high-binder alloys in which the volume of the ductile second phase comprises at least 30% by volume of the total volume.

According to Deng, X. et al., Int. J. Refr. & Hard Materials 19(201) 547-552, advantages in fracture toughness of double cemented carbides over conventional cemented carbides are obtained only for hardness values of below about HV=1300. This solution is directed to mining tools with high toughness requirements, and offers possibilities for replacing steel by a more wear-resistant cemented carbide. However, this approach cannot be transferred to types with a lower binder content, as usually employed, for example, in alloys for metal machining or wood working. Another critical disadvantage is the fact that the strength drops by about 30% because of the coarse deposits.

The above described disadvantages are to be overcome with the present invention.

SUMMARY OF THE INVENTION

The object of the present invention is to provide a cemented carbide having an excellent combination of mechanical properties, especially in view of the hardness, strength and above all fracture toughness, wherein the preparation thereof is performed without the use of presynthesized bimodal cemented carbide polycrystals, in contrast to the prior art.

In addition, a particular object of the present invention is to prepare an ultrafine or nanoscale cemented carbide with a Vickers hardness of at least 1500 HV10, and a structure that has structure features that act against crack propagation despite a very low average free length of path in the binder (in an orienting way, but not exclusively $I_{binder}$<100 nm).

Further, a sintering method for preparing such a cemented carbide, preferably an ultrafine or nanoscale cemented carbide, that allows for the production of components with a complex geometry and a broad versatility of shapes should be used within the scope of the present application. Finally, a cemented carbide is to be obtained that does not require the previous complicated preparation and conversion of bimodal cemented carbide powders.

DETAILED DESCRIPTION OF THE INVENTION

Within the scope of the present invention, a specific cemented carbide based on ultrafine or nanoscale monomodal hard material particles, especially tungsten carbide powders, has been developed that actually exhibits the improved combination of hardness and fracture toughness as sought over the prior art by a particular heterogeneous distribution of the binding metal.

Within the scope of the present invention, the achieved increase in toughness while the hardness of the material remains the same is achieved because, in addition to the nanoscale and/or ultrafine hard material phase, small homogeneously distributed binder accumulations (so-called binder islands) that can put a higher resistance against crack propagation in the resulting toughness-enhancing structure and thus enable the increased fracture toughness are formed during the preparation of the claimed toughness-enhancing structure.

The claimed cemented carbide with the advantageous properties could be made available by the preparation method as described in the following.

In a first process step, a hard material powder is provided. The hard material powder according to the invention preferably consists of monomodal hard material grains made of crystallites of the carbides, nitrides and/or carbonitrides of the transition metals of the Groups 4B, 5B and 6B of the Periodic Table of the Elements. Preferably, WC, TiC, TaC, NbC, WTiC, TiCN, TiN, VC, $Cr_3C_2$, ZrC, HfC, $Mo_2C$ or a mixture of these components may be mentioned.

In the most preferred embodiment, the hard material powder comprises or consists at least partially, or alternatively completely, of tungsten carbide particles.

According to the present invention, suitable hard material powders are usually in a monomodal form. In the hard material powder according to the invention, bimodal hard material powders are not normally employed.

Previously employed bimodal hard material powders have bimodal character either in view of their grain size distribution and/or in view of their respective chemical and elemental components. Bimodal hard material powders based on a bimodal chemical or elemental composition have two different powder components with different chemical or elemental compositions. Then, because of the different compositions, different ductilities for the respective components in the bimodal hard material powder may result, for example.

Bimodal hard material powders based on a bimodal grain size distribution have two separate grain size peaks with respect to the corresponding frequency distributions, i.e., to put it more simply, consist of a mixture of two hard material powders with two different grain sizes. The same applies, mutatis mutandis, for multimodal grain size distributions with optionally more than two different grain size distributions, i.e., more than two different grain sizes.

In contrast, the monomodal (or unimodal) hard material powder according to the invention consists of only one powder component, which is unitary with respect to its chemical or elemental components and with respect to its grain size distribution. In other words, the grain size distribution of the monomodal hard material powder has only one clearly defined peak with respect to the frequency distribution of grain size, i.e., the hard material powder according to the invention essentially comprises only one defined grain size, and thus does not comprise a mixture of several powder components having different grain sizes.

Preferably, the hard material powder has a particle size of <1 μm. This size range is a first requirement in order that the corresponding material can be sintered to a sufficient density by solid-phase sintering.

The hard material powder has a mean BET grain size of less than 1.0 μm or 0.8 μm, preferably less than 0.5 μm, more preferably less than 0.3 μm, and even more preferably less than 0.2 μm.

In particular, the hard material powders used within the scope of the invention are so-called nanoscale and/or ultrafine hard material powders. Therefore, nanoscale hard material powders, especially those made of tungsten carbide as the hard material, have a mean BET grain size of smaller than 0.2 μm. Ultrafine hard material powders, especially those made of tungsten carbide as the hard material, have a mean BET grain size of from 0.2 μm to 0.4 μm, or up to 0.5 μm.

In a second process step, the hard material powder is mixed with a binder metal powder. The binder component is preferably a binder metal, which is in the form of a powder. The binder metal is preferably selected from the group of metals consisting of cobalt, iron, nickel, and combinations thereof. Cobalt is most preferred as the binder metal.

The binder metal powder has a mean FSSS (Fisher sub-sieve sizer) grain size of less than 5 μm, preferably less than 3 μm, more preferably less than 2 μm, and even more preferably less than 1 μm. The binder metal powder may not only have a monomodal binder component, but alternatively, it may also have a bimodal or even multimodal binder component.

The proportion of the admixed binder powder, based on the total weight of the (overall) powder mixture containing the hard material, binder metal and all the other optional additives, before the pressing into the green body is from 2% by mass to 30% by mass, preferably from 5% by mass to 20% by mass, and even more preferably from 6% by mass to 15% by mass.

In another preferred embodiment of the present invention, additional pressing aids or sintering aids may also be added for the preparation of the green body and/or the subsequent sintering of the green body during the preparation of the powder mixture.

The mixing of hard material powder and binder metal may be effected in any desired way and using usual devices. The mixing may be effected dry or using a liquid grinding medium, such as water, alcohol, hexane, isopropanol, acetone, or other solvents.

Mixers, mills or similar suitable devices, for example, ball mills or attritors, may be used for the mixing. The mixing is performed in a way and over a period suitable for obtaining a uniformly distributed mixture of all components.

The powdery hard material is usually mixed with the binder component and optionally the further components for preparing the cemented carbide. Preferably, the mixing is performed in an organic grinding medium or water with the addition of a plasticizer, mostly paraffin, in an attritor or a ball mill. After sufficient comminution and mixing, the wet mass is dried and granulated. The drying is performed, for example, in a spraying tower.

Since a structure becoming coarser and coarser may occur in the cemented carbide with increasing temperature and sintering time, and since the coarsening of the hard material grain, preferably the tungsten carbide grains, will usually also be associated with a decrease in hardness and at the same time an increase of toughness, grain growth inhibitors may optionally be admixed in addition for reducing the grain growth, which prevent or, at least in part, inhibit the growth of the hard material grains, especially the tungsten carbide grains.

Grain growth inhibitors may be admixed either already to the hard material powder before the addition of the binder, alloyed already in the hard material powder during the synthesis, or alternatively be admixed with the hard material powder together with the binder component.

In the cemented carbide containing a binder component, for example, in a system based on tungsten carbide as the hard material and cobalt as the binder, this effect of inhibiting the grain growth can be used very advantageously by admixing vanadium carbide (VC) or other grain growth inhibitors, such as chromium carbide ($Cr_3C_2$), tantalum carbide, titanium carbide, molybdenum carbide, or mixtures thereof.

Using the grain growth inhibitors, the grain growth is essentially suppressed, so that particularly fine textures can be produced, in which the average free length of path then falls short of the critical dimension of the binder film for the transition from ductile to brittle. In this way, the inhibition of the grain growth by the admixture of a limited amount of grain growth inhibitor can make an important contribution to achieving the claimed technical effect.

The addition of a powdery grain growth inhibitor is effected in a proportion of from 0.01% by mass to 5.0% by mass, preferably from 0.1% by mass to 1.0% by mass, based on the total weight of the mixture.

The shaping of the powder mixture consisting of the hard material powder together with the binder component and optionally further optional additions can be effected by established methods, for example, by cold isostatic pressing or template pressing, extrusion, injection molding, and comparable known methods.

The shaping results in green bodies and preferably achieves a relative density, based on the theoretical density of at least 35%, preferably 45%, more preferably >55%.

Previously employed methods for the preparation of usable cemented metals are based on the fact that the green body is heated or sintered after shaping to such an extent that the binder metal can distribute as a liquid phase homogeneously between the hard material particles.

In contrast, the compacting process according to the invention during the sintering of the green body must be performed in such a way that, although the binder metal penetrates in all the pores of the hard material regions, it cannot distribute uniformly over the tungsten carbide grains, but binder islands are maintained in the structure during the sintering. However, this must result in a pore-free structure. Therefore, solid phase sintering is the preferred sintering method.

The binder islands that are present in the structure after the sintering process have an average size of from 0.1 μm to 10.0 μm, preferably from 0.2 μm to 5.0 μm, more preferably from 0.5 μm to 1.5 μm. The average size of the binder islands is determined on ground sections with an electron microscope using linear analysis (linear intercept method).

In addition, in the cemented carbide with toughness-increasing structure according to the invention, the binder islands have an average distance between neighboring binder islands of from 1.0 μm to 7.0 μm, preferably from 2.0 μm to 5.0 μm, more preferably from 1.0 μm to 4.0 μm. The average distance between neighboring binder islands is determined on ground sections with an electron microscope using linear analysis (linear intercept method).

The existence of the binder islands is a critical structural feature in the claimed toughness-increasing structure of the cemented carbide, because the presence of the binder islands produces regions where the propagation of cracks is hindered, resulting in the unprecedented pronounced fracture toughness.

The sintering according to the invention is preferably effected by solid phase sintering, i.e., at a temperature in which liquefaction of the binder component in the green body does not occur during the sintering, and therefore the binder metal cannot distribute as a liquid phase between the hard material particles.

In a particularly preferred embodiment, the toughness-increasing structure according to the invention comprising the binder islands just described is obtained by performing a complete compaction by exclusively solid-phase sintering processes below the eutectic melting temperature of the alloyed binder.

Mostly, the solid-phase sintering according to the invention will be effected at a temperature that is from 10 k to 500 K, preferably from 50 K to 450 K, more preferably from 50 K to 350 K, or even from 50 K to 250 K, below the eutectic melting temperature of the binder, which is optionally alloyed, and the holding time for the sintering step is from 5 min to 480 min, preferably from 20 min to 360 min, and more preferably from 30 min to 120 min. The eutectic melting temperature of the binder metal is determined by DSC on a routine basis, being obtained from the components of the whole system including the hard material, the binder, and optionally grain growth inhibitors. The skilled person is familiar with this determination method.

Cobalt is a particularly preferred binder metal. When cobalt as the binder and tungsten carbide as the hard material are used, the preferred solid phase sintering temperature according to the invention is within a range of from 1000° C. to 1485° C., preferably within a range of from 1050° C. to 1275° C., more preferably within a range of from 1100° C. to 1250° C.

Thus, particularly preferred is a sintering process at a temperature at which a completely solid, pore-free, structure is achieved, but larger binder regions (binder islands) have not yet dissolved and distributed completely.

All commonly used sintering methods may be used as suitable solid phase sintering methods. Suitable solid phase sintering methods include, in particular, the following techniques: spark plasma sintering, electrodischarge sintering, hot pressing, or gas pressure sintering (sinter HIP).

Further, the island formation of the binder may also be controlled by the selection of the binder powder employed (primary grain size of the binder), and by a mixture of very fine and coarse binder powders. The grain size of the binder employed was described in some detail above.

The sintering according to the invention may optionally be effected under a reducing atmosphere or inert atmosphere. Preferably, the sintering is effected in the presence of a vacuum (residual gas pressure) of less than 100 mbar, or more preferably under a vacuum of less than 50 mbar (argon, nitrogen, hydrogen, etc.).

After the sintering, i.e., preferably after the solid phase sintering, an additional postcompaction of the cemented carbide at a pressure of from 20 bar to 200 bar, preferably from 40 bar to 100 bar, may optionally be performed subsequently to the sintering.

Liquid sintering instead of or in addition to solid phase sintering is also a possible, although less preferred, embodiment within the scope of the present invention, but only as long as the liquid sintering of the green body is terminated in due time, so that the binder is not homogeneously distributed in the structure during the liquid sintering.

Within the scope of the present invention, a very fine-grained structure of a cemented carbide is obtained within the scope of the preparation process according to the invention. This product preferably consists of an ultrafine or nanoscale hard material phase according to the definition by the working group "cemented carbides" in the powder metallurgy association, which is modified by the specific process control in such a way that at least parts of the metallic binder phase exist as a ductile component of the alloy while the high fineness of the structure and the short average free length of path of the binder are maintained.

This ductile binder phase may then reduce the fracture energy in contact with a propagating fracture by deformations and thus act against further propagation of the fracture, so that an improved fracture toughness is obtained thereby for the cemented carbide according to the invention.

According to the conventional understanding, a cemented carbide structure with a non-uniform distribution of the binder, i.e., in which the binder is not uniformly distributed between the hard material grains, but at singular sites, there are also binder regions whose dimensions are clearly above the average grain size of the hard material phase, have been considered as "undersintered". However, in the prior art, the predominant opinion to date has been that undersintered cemented hard material structures had insufficient mechanical properties.

In contrast, it has been surprisingly found within the scope of the present invention that this previously widespread understanding is not correct for extremely fine cemented carbide structures, especially for nanoscale and ultrafine cemented carbide structures, in which the average grain size of the hard material phase is below 1 μm, especially below 0.5 μm. In order to simultaneously achieve a high hardness and toughness by the concept according to the invention, the inventors now rather propose particularly fine structures with homogeneously distributed coarser binder regions. However, the binder regions in turn should not exceed a critical size, because otherwise highly heterogeneous properties may occur in the cemented carbide.

In detail, the cemented carbide according to the invention has the following essential features.

The hard material according to the invention preferably consists of hard material grains consisting of crystallites of the carbides, nitrides and/or carbonitrides of the transition metals of the Groups 4B, 5B and 6B of the Periodic Table of the Elements. Preferably, WC, TiC, TaC, NbC, WTiC, TiCN, TiN, VC, $Cr_3C_2$, ZrC, HfC, $Mo_2C$ or a mixture of these components may be mentioned.

A particularly preferred hard material within the scope of the present invention is pure tungsten carbide. In further preferred embodiments, tungsten carbide in connection with further carbides may be present as the hard material. In particular, titanium carbide, tantalum carbide, vanadium carbide, molybdenum carbide, and/or chromium carbide, may be present together with tungsten carbide.

The additional carbides besides tungsten carbide will preferably be present in an amount that does not exceed 5.0% by mass, or more preferably 3.0% by mass, based on the total weight of the cemented carbide obtained after sintering.

In particular, WC-based cemented carbides with high proportions of additional carbides, so-called "P-cemented carbides", may also be meant within the scope of the present invention.

The average grain size of the hard material grain in the cemented carbide after sintering is maximally 1.0 μm, preferably maximally 0.8 μm, more preferably maximally 0.5 μm, and even more preferably maximally 0.3 μm, or even only maximally 0.15 μm, and on the other side is 1 nm or larger, preferably 50 nm or larger. The average grain size is determined on ground sections with an electron microscope using linear analysis (linear intercept method).

The hard material or the hard material phase in the cemented carbide according to the invention is usually present in a monomodal form. Bimodal hard material phases normally do not occur in the cemented carbide according to the invention.

The bimodal hard material phases may have bimodal character either in view of their grain size distribution and/or in view of their respective elemental components. Bimodal hard material phases based on a bimodal chemical or elemental composition have two different hard material components with different chemical or elemental compositions in the cemented carbide.

Bimodal hard material phases based on a bimodal grain size distribution have two separate grain size peaks with respect to the corresponding frequency distributions, i.e., to put it more simply, consist of a mixture of two hard material phases with two different grain sizes. The same applies, mutatis mutandis, for multimodal hard material phases.

In contrast, the cemented carbide according to the invention consists of a monomodal (unimodal) hard material or a monomodal (or unimodal) hard material phase. Thus, the hard material is unitary with respect to its chemical or elemental components and with respect to its grain size distribution. This is a central difference between the cemented carbides according to the invention and the previously described cemented carbide structures, which could achieve good properties in terms of hardness and fracture toughness only because of their bimodal hard material phase.

In addition, in the cemented carbide structures according to the invention, the hard material is preferably present in a so-called nanoscale and/or ultrafine grain size.

The grain size of the hard material in the cemented carbide structures is measured according to DIN EN ISO 4499-2, 2010, by the linear intercept method.

Nanoscale cemented carbide structures, especially those made of tungsten carbide as the hard material, have a grain size of smaller than 0.2 μm. Ultrafine cemented carbide structures, especially those made of tungsten carbide as the hard material, have a grain size of from 0.2 μm to 0.4 μm, or to a maximum of 0.5 μm.

The cemented carbide according to the invention contains a binder or binder metals. Preferred binder metals include iron, cobalt, nickel, or mixtures of these metals. Cobalt is particularly preferred as the binder metal.

The binder is present only in limited amounts in the cemented carbide. Thus, the proportion of the binder, based on the total weight of the whole cemented carbide product obtained after the sintering is at most 30% by mass, preferably at most 25% by mass, more preferably at most 20% by mass, and most preferably at most 15% by mass. On the other hand, an ideal proportion of the binder, based on the total amount of the cemented carbide product obtained after the sintering, is at most 12% by mass.

In addition, the proportion of the binder, based on the total amount of the cemented carbide product after the sintering, is preferably an amount of at least 2.0% by mass, more preferably an amount of at least 6.0% by mass.

Optionally, in order to reduce grain growth during sintering, grain growth inhibitors may be additionally present in the cemented carbide. Therefore, the cemented carbide according to the invention containing a binder component, for example, a system based on tungsten carbide as the hard material and cobalt as the binder, may additionally contain titanium carbide, vanadium carbide, chromium carbide ($Cr_3C_2$), tantalum carbide, molybdenum carbide, and mixtures of such components.

In this embodiment, the grain growth inhibitor is present in a proportion of from 0.01% by mass to 8.0% by mass, preferably from 0.01% by mass to 3.0% by mass, based on the total weight of the cemented carbide product after sintering.

The optional presence of the grain growth inhibitor in the cemented carbide may be helpful, because grain growth can be suppressed better thereby, so that particularly fine structures can be produced, in which the average free length of path then falls below the critical dimension of the cobalt film for the ductile-to-brittle transition.

In the inventor's experiments, the presence of binder islands having an average size of 0.2 μm to 2.0 μm in the cemented carbide after sintering has proven particularly important technically. In particular, as set forth above, the binder islands have an average size of from 0.1 μm to 10.0 μm, preferably from 0.2 μm to 5.0 μm, more preferably from 0.5 μm to 1.5 μm, in the cemented carbide after sintering. The average size is determined on ground sections with an electron microscope using linear analysis (linear intercept method).

In addition, in the cemented carbide structure according to the invention, the binder islands have an average distance between neighboring binder islands of from 1.0 μm to 7.0 μm, preferably from 2.0 μm to 5.0 μm, more preferably from 1.0 μm to 4.0 μm. The average distance between neighboring binder islands is determined on ground sections with an electron microscope using linear analysis (linear intercept method).

In contrast to the conventional understanding, according to which a structure with a non-uniform cobalt distribution (cobalt pools etc.) whose size exceeds the average grain size of the hard material phase has poor properties and is considered as "undersintered", it has surprisingly been found that this statement is not correct for extremely fine structures (for example, with an average grain size of not more than 0.3 μm).

Within the scope of the present invention, it has been demonstrated that the presence of these binder islands, preferably cobalt islands, with typical dimensions of about 1.0 μm to 7.0 μm, i.e., on an order of magnitude that clearly exceeds the average grain size of the hard material phase, and preferably also the average free length of path of the binder, hinders the propagation of cracks in a cemented carbide much more than thin binder layers would, and that thereby, as also surprisingly demonstrated here, the fracture toughness of the cemented carbide is significantly increased.

For additional illustration of this important structural feature, reference is made to the comparison of samples of FIGS. 1 and 2 or 3 and 4. In all Figures, a nanoscale cemented carbide with a composition of WC 10Co 0.9VC was analyzed. In contrast to FIGS. 1 and 3 (sample obtained by sintering at 1300° C.), FIGS. 2 and 4 (sample obtained by solid phase sintering at 1200° C.) show the presence of the binder islands according to the invention. In the concrete example, these are cobalt islands. In contrast, when sintered at a temperature of 1300° C. (FIGS. 1 and 3), the DSC curve already showed partial liquefaction of the binder component, so that this is no longer solid phase sintering. Therefore, FIGS. 1 and 3 show a structure that has no cobalt islands according to the invention.

The hardness and fracture toughness values respectively found for the cemented carbide samples according to FIGS. 3 and 4 (sample of FIG. 3: hardness HV 10=1940; fracture toughness $K_{Ic}$=7.9 MPa·m$^{1/2}$; sample of FIG. 4: hardness HV 10=2080; fracture toughness $K_{Ic}$=8.3 MPa·m$^{1/2}$) show that significantly higher hardness values can be achieved with the cobalt islands while the fracture toughness remains the same or is even higher in the cemented carbides according to the invention.

The cemented carbide according to the invention preferably has a Vickers hardness according to DIN ISO 3878 of at least 1500 HV 10, preferably at least 1700 HV 10, more preferably at least 1850 HV 10, or even at least 2000 HV 10, while the fracture toughness of the cemented carbide according to Shetty et al. is at least 6.0 MPa·m$^{1/2}$, preferably at least 8.0 MPa·m$^{1/2}$.

BRIEF DESCRIPTION OF THE DRAWINGS

The Vickers hardness HV10 of the cemented carbides is determined according to DIN ISO 3878. The calculation of fracture toughness was performed by the method according to D. K. Shetty, I. G. Wright, P. N. Mincer. A. H. Clauer; J. Mater. Sei. (1985), 20, 1873-1882.

Thus, preferred cemented carbides A to H according to the invention with specific combinations of the Vickers hardness and fracture toughness are as follows:

Figure 1:
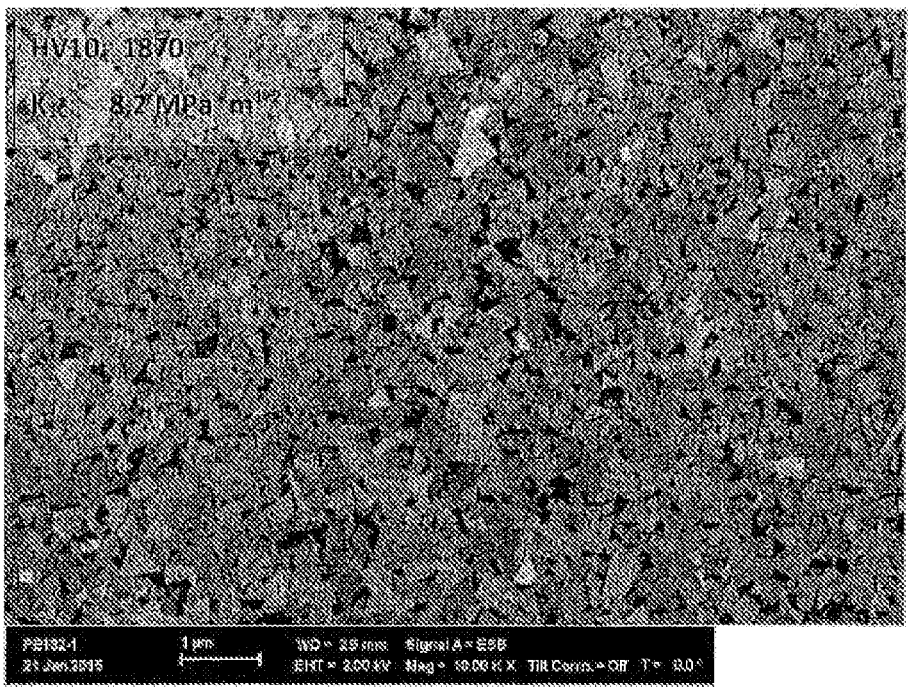

| Preferred embodiments of the cemented carbide in terms of hardness and fracture toughness | Vickers hardness HV 10 | Fracture toughness according to Shetty et al. |
|---|---|---|
| A | at least 1500 | at least 6.0 MPa · m$^{1/2}$ |
| B | at least 1700 | at least 6.0 MPa · m$^{1/2}$ |
| C | at least 1850 | at least 6.0 MPa · m$^{1/2}$ |
| D | at least 2000 | at least 6.0 MPa · m$^{1/2}$ |
| E | at least 1500 | at least 8.0 MPa · m$^{1/2}$ |
| F | at least 1700 | at least 8.0 MPa · m$^{1/2}$ |
| G | at least 1850 | at least 8.0 MPa · m$^{1/2}$ |
| H | at least 2000 | at least 8.0 MPa · m$^{1/2}$ |

The cemented carbide with a toughness-increasing structure as obtained by the production process according to the invention contains, in terms of structure, a phase of nanoscale and/or ultrafine, preferably monomodal, cemented carbide grain and binder islands dispersed therein, wherein the cemented carbide (as obtained after sintering) with the toughness-increasing structure contains a phase of hard material grain having an average grain size within a range of from 1 nm to 1000 nm, preferably from 100 nm to 500 nm, and binder islands having an average size of from 0.1 μm to 10.0 μm, preferably from 0.2 μm to 5.0 μm, more preferably from 0.5 μm to 3.0 μm, or even from 1.0 μm to 1.5 μm, and an average distance between neighboring binder islands of from 1.0 μm to 7.0 μm, preferably from 2.0 μm to 5.0 μm.

Another preferred embodiment relates to the above preferred cemented carbides of Embodiments A to H having a Vickers hardness according to DIN ISO 3878 of at least 1500 HV 10, preferably at least 1700 HV 10, or at least 1850 HV 10, or even at least 2000 HV 10, and a fracture toughness according to Shetty et al. of at least 6.0 MPa·m$^{1/2}$, preferably at least 8.0 MPa·m$^{1/2}$, wherein such cemented carbides are obtained by the above described production process according to the invention and its preferred embodiments.

Another preferred embodiment relates to a cemented carbide comprising a phase of hard material grain and binder islands dispersed therein, characterized in that the cemented carbide obtained after sintering contains a phase of hard material grain having an average grain size within a range of from 1 nm to 1000 nm, preferably from 100 nm to 500 nm, and said binder islands have an average size of from 0.1 μm to 10.0 μm, preferably from 0.2 μm to 5.0 μm, and an average distance between neighboring binder islands of from 1.0 μm to 7.0 μm, preferably from 2.0 μm to 5.0 μm, wherein such cemented carbide is obtained by the production process according to the invention and its preferred embodiments.

The technical features described and the production process described enable, in particular, the hardness and fracture toughness of ultrafine and/or nanoscale cemented carbides to be increased simultaneously without requiring new raw materials or specific sintering plants.

The cemented carbides according to the invention reach a high technical importance wherever particularly fine-grained cemented carbides are employed, i.e., in the machining of materials or hardened steels that are difficult to machine, especially with rotating tools, such as drills and full cemented carbide milling tools, for the fabrication of thread cutters, especially also for the fabrication of internal threads, in the fabrication of tools for cutting and punching metals, paper, cardboard, plastics or magnetic tapes, and in wear parts and construction components made of cemented carbides, such as gaskets, extrusion punches and press dies. Also, all rotary machining processes in which indexable inserts are employed may be mentioned.

The invention will be explained by way of example by the following Figures:

FIG. 1 shows an electron micrograph of the structure of a cemented carbide having a composition of WC 10Co 0.6VC $0.3Cr_3C_2$, wherein sintering at 1300° C. with a holding time of 90 min was effected in the production.

Figure 2:
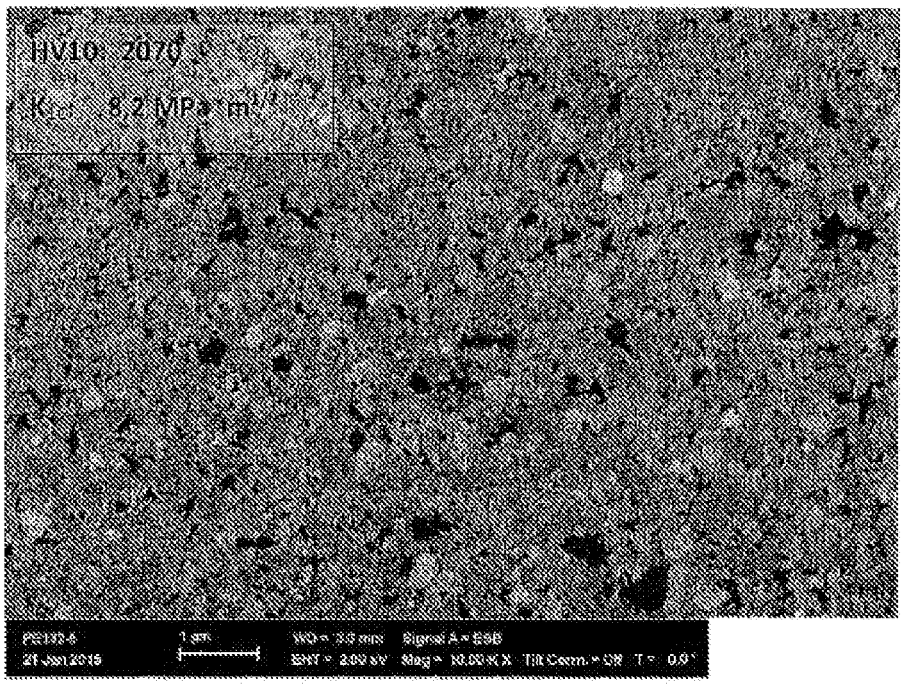

FIG. 2 shows an electron micrograph of the structure of a cemented carbide having a composition of WC 10Co 0.6VC $0.3Cr_3C_2$, wherein solid-phase sintering at 1200° C. with a holding time of 90 min was effected in the production.

Figure 3:
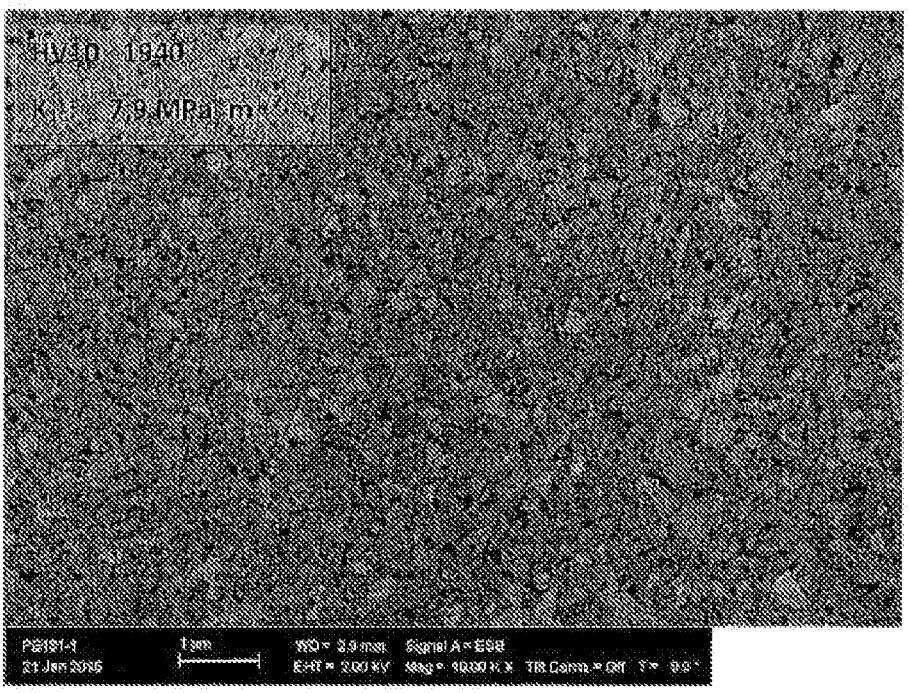

FIG. 3 shows an electron micrograph of the structure of a cemented carbide having a composition of WC 10Co 0.9VC, wherein sintering at 1300° C. with a holding time of 90 min was effected in the production.

Figure 4:
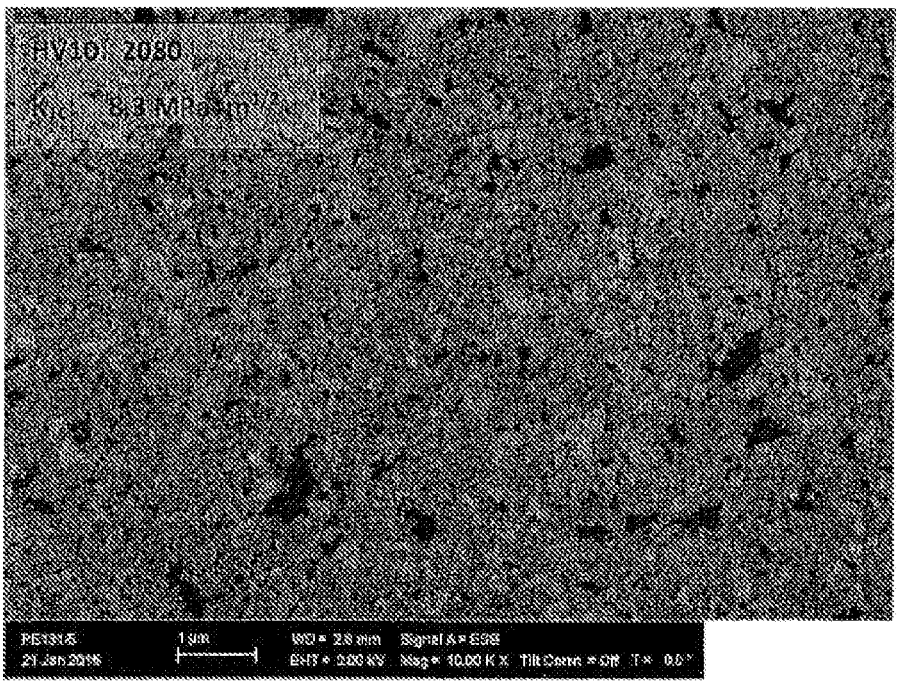

FIG. 4 shows an electron micrograph of the structure of a cemented carbide having a composition of WC 10Co 0.9VC, wherein solid-phase sintering at 1200° C. with a holding time of 90 min was effected in the production.

The invention claimed is:

1. A cemented carbide comprising a phase of hard material grains and a phase of a heterogeneously distributed binder metal, characterized in that said hard material grains have an average grain size within a range of from 50 nm to 150 nm, and said heterogeneously distributed binder metal is present in the form of binder islands within the cemented carbide that have an average size 0.1 μm to 10.0 μm, and an average distance between neighboring binder islands of from 1.0 μm to 7.0 μm.

2. The cemented carbide according to claim 1, characterized in that said hard material phase includes tungsten carbide.

3. The cemented carbide according to claim 1, characterized in that the hard material grain in said hard material phase is present in a monomodal form with respect to its chemical-elemental composition and/or with respect to its grain size distribution.

4. The cemented carbide according to claim 1, characterized in that the binder islands contain a metal selected from the group consisting of cobalt, iron, nickel, and combinations thereof.

5. The cemented carbide according to claim 1, characterized in that the proportion of the binder, based on the total weight of the cemented carbon, is from 2% by mass to 30% by mass.

6. The cemented carbide according to claim 1, characterized in that the hard material additionally comprises at least one powdery grain growth inhibitor selected from titanium carbide, vanadium carbide, chromium carbide, tantalum carbide, molybdenum carbide, and mixtures thereof.

7. The cemented carbide according to claim 6, characterized in that said grain growth inhibitor is present in a proportion of from 0.01% by mass to 5.0% by mass, based on the total weight of the cemented carbide.

8. The cemented carbide according to claim 1, characterized in that the Vickers hardness is of at least 1500 HV 10, and the fracture toughness is at least 6.0 $MPa \cdot m^{1/2}$.

9. A process for producing the cemented carbide of claim 1 with a toughness-increasing structure, comprising the following steps:

providing a hard material powder, in which the mean BET grain size of the hard material powder is less than 1.0 μm;

mixing the hard material powder with a binder powder;

shaping the mixture of hard material powder and binder powder into a green body; and sintering the green body;

characterized in that said sintering of the green body is effected by solid phase sintering into a compact, pore-free cemented carbide.

10. The process according to claim 9, characterized in that said hard material includes tungsten carbide.

11. The process according to claim 9, characterized in that said hard material powder is present in a monomodal form with respect to its chemical-elemental composition and/or with respect to its grain size distribution.

12. The process according to claim 9, characterized in that said step of solid phase sintering is performed by at least one of the following sintering methods: spark plasma sintering, electrodischarge sintering, hot pressing, and/or gas pressure sintering, and/or by a sinter HIP method.

13. The process according to claim 9, characterized in that said sintering is effected at a temperature that is from 10 K to 500 K, below the eutectic melting temperature of the binder, and the holding time is from 5 min to 480 min.

14. The process according to claim 9, characterized in that said binder powder is selected from the group of metals consisting of cobalt, iron, nickel, and combinations thereof.

15. The process according to claim 9, characterized in that the proportion of the binder powder, based on the total weight of the powder mixture before being shaped into the green body, is from 2.0% by mass to 30.0% by mass.

16. The process according to claim 9, characterized in that the sintering is effected under a vacuum of less than 100 mbar.

17. The process according to claim 9, characterized in that an additional postcompaction of the cemented carbide is performed at a pressure of from 20 bar to 200 bar, after the sintering.

18. The process according to claim 9, characterized in that said hard material powder additionally comprises at least one powdery grain growth inhibitor selected from vanadium carbide, chromium carbide, tantalum carbide, titanium carbide, molybdenum carbide, and mixtures thereof.

19. The process according to claim 18, characterized in that said powdery grain growth inhibitor is present in the green body before the shaping in a proportion of from 0.01% by mass to 5.0% by mass, based on the total weight of the powder mixture.

20. A cemented carbide having a Vickers hardness of at least 1500 HV 10, and a fracture toughness of at least 6.0 $MPa \cdot m^{1/2}$, obtained by the process according to claim 9.

21. Drills, full cemented carbide milling tools, indexable inserts, sawteeth, reforming tools, gaskets, extrusion punches, press dies, and wear parts comprising the cemented carbide according to claim 1.

22. A method for increasing hardness and fracture toughness of tools with definite and indefinite edges comprising fabricating said tools with the cemented carbide according to claim 1.

* * * * *